US009950914B2

(12) United States Patent
Holmberg et al.

(10) Patent No.: US 9,950,914 B2
(45) Date of Patent: Apr. 24, 2018

(54) METHOD FOR OPERATING WINCH, AND WINCH

(71) Applicant: ABB Oy, Helsinki (FI)

(72) Inventors: Mikael Holmberg, Porvoo (FI); Risto Tiihonen, Kotka (FI); Asko Salminen, Espoo (FI)

(73) Assignee: ABB Oy, Helsinki (FI)

( * ) Notice: Subject to any disclaimer, the term of this patent is extended or adjusted under 35 U.S.C. 154(b) by 529 days.

(21) Appl. No.: 14/626,287

(22) Filed: Feb. 19, 2015

(65) Prior Publication Data

US 2015/0266707 A1 Sep. 24, 2015

(30) Foreign Application Priority Data

Mar. 18, 2014 (EP) ..... 14160486

(51) Int. Cl.

*B66D 1/38* (2006.01)
*B66D 1/12* (2006.01)
*B66D 1/48* (2006.01)
*B66D 1/60* (2006.01)

(52) U.S. Cl.

CPC ..... *B66D 1/38* (2013.01); *B66D 1/12* (2013.01); *B66D 1/48* (2013.01); *B66D 1/60* (2013.01)

(58) Field of Classification Search

CPC . B66D 1/12; B66D 1/36; B66D 1/365; B66D 1/38; B66D 1/39; B66D 1/40; B66D 1/46; B66D 1/48; Y10S 242/01

USPC ..... 254/362; 242/483.3

See application file for complete search history.

(56) References Cited

U.S. PATENT DOCUMENTS 2,757,884 A * 8/1956 Bryant ..... B65H 54/2803 242/483.3
2,900,145 A * 8/1959 Hanson ..... B65H 54/2863 242/478.2
3,565,357 A * 2/1971 Noguchi ..... B65H 54/2851 242/413.4

(Continued)

FOREIGN PATENT DOCUMENTS

CN 101734569 A 6/2010
CN 101879643 A 11/2010

(Continued)

OTHER PUBLICATIONS

Chinese Office Action dated Nov. 3, 2016; Chinese Application No. 201510111675.8; Applicant: ABB OY; 5 pgs.

(Continued)

*Primary Examiner* — Michael E Gallion
(74) *Attorney, Agent, or Firm* — Taft Stettinius & Hollister LLP

(57) ABSTRACT

A method for operating a winch and a winch having a winch drum for spooling a spoolable medium, wherein the winch drum is rotatable about a first axis, a guiding member for guiding the spoolable medium, wherein the guiding member is movable along a second axis between two end positions, and an electric drive having a first electric motor for driving the guiding member towards one of the two end positions during spooling in or spooling out of the spoolable medium. The electric drive is configured to change the driving direction of the guiding member when a monitored torque of the first electric motor, or a quantity indicative thereof, exceeds a predetermined threshold.

20 Claims, 1 Drawing Sheet

(56) References Cited

U.S. PATENT DOCUMENTS 3,657,628 A * 4/1972 Chesney ..... G05B 19/42 242/DIG. 1
3,734,421 A * 5/1973 Karlson ..... H02P 5/51 156/189
3,809,334 A * 5/1974 Beurer ..... B64D 1/22 242/390.2
4,235,394 A * 11/1980 Fry ..... B65H 54/2854 242/397.3
4,334,670 A * 6/1982 Kawabe ..... B66D 1/16 242/397.3
4,617,971 A * 10/1986 Hellstroem ..... D03D 47/367 139/370.2
4,629,145 A * 12/1986 Graham ..... B65H 54/2866 242/483.3
RE33,240 E * 6/1990 Lothamer ..... B65H 54/325 242/118.4
5,184,786 A * 2/1993 Brockmanns ..... B65H 54/40 242/413
5,209,414 A * 5/1993 Clemens ..... B65H 54/10 242/478.2
6,443,431 B1 * 9/2002 Stasny ..... B66D 1/38 242/157.1
2002/0011537 A1 * 1/2002 Durrstein ..... B60R 22/343 242/390.8
2005/0082517 A1 * 4/2005 Steiner ..... B62D 43/045 254/323
2008/0265226 A1 * 10/2008 Richards ..... B66D 1/38 254/267
2012/0097783 A1 * 4/2012 Pack ..... B65H 75/425 242/416
2014/0091268 A1 * 4/2014 Heravi ..... B66D 1/505 254/274

FOREIGN PATENT DOCUMENTS

CN 103626066 A 3/2014
EP 0259656 A1 3/1988
JP 8-301580 A 11/1996
JP 2002-087763 A 3/2002
WO WO 2006/027553 A1 3/2006

OTHER PUBLICATIONS

Search Report dated Sep. 11, 2014, by the European Patent Office for Application No. 14160486.

* cited by examiner

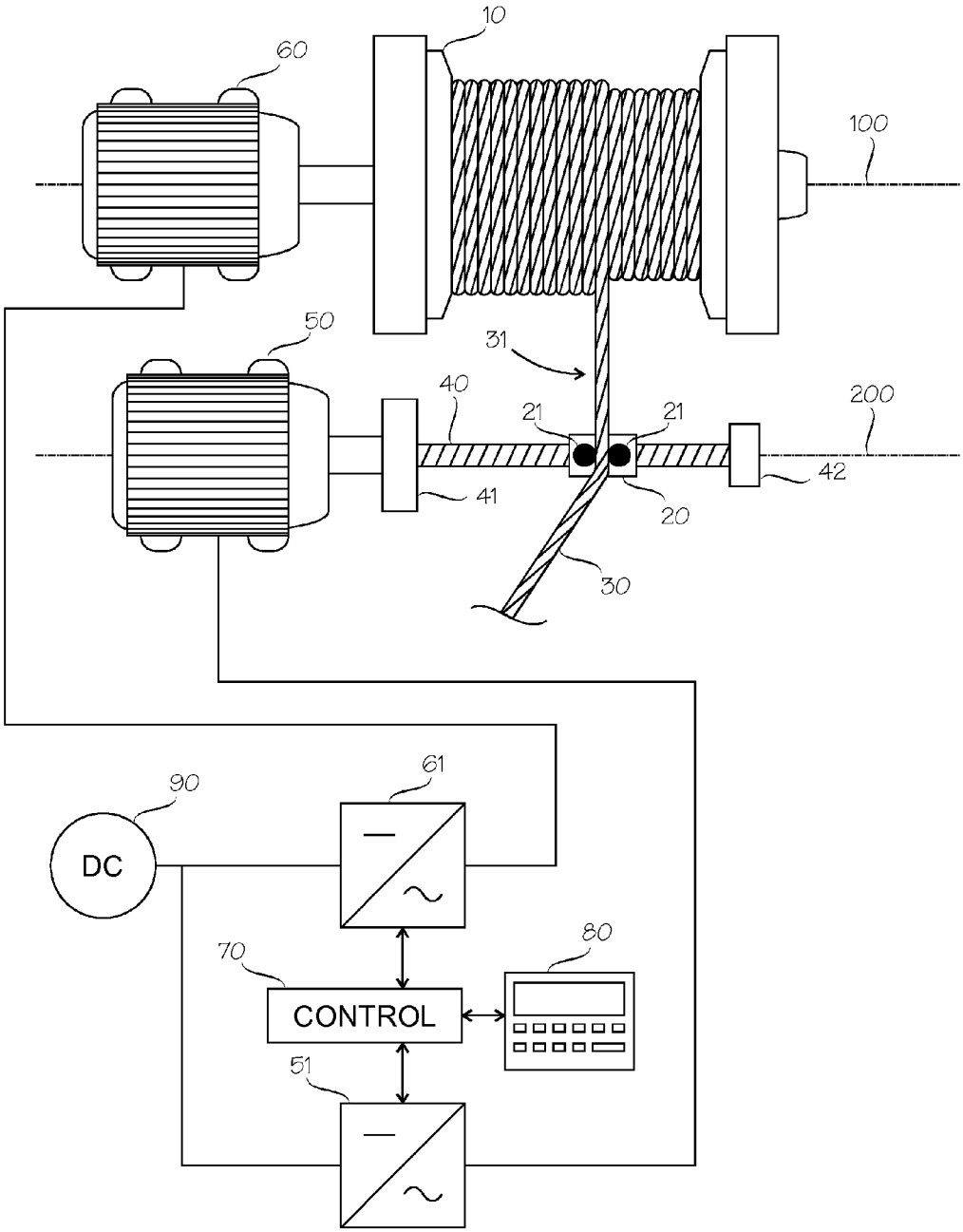
10
60
100
50
31
40
21
21
200
42
41
20
30
90
61
DC
70
80
CONTROL
51

METHOD FOR OPERATING WINCH, AND WINCH

RELATED APPLICATION

This application claims priority under 35 U.S.C. § 119 to European Patent Application No. 14160486.8 filed in Europe on Mar. 18, 2014, the entire content of which is hereby incorporated by reference in its entirety.

FIELD

The present disclosure relates to operating a winch, and to a winch.

BACKGROUND INFORMATION

Winches may be used in connection with many applications. Examples include a ship anchor winch, a mooring winch, a ramp winch or a towing winch.

A winch can include a winch drum rotatable about an axis and used for spooling a spoolable medium such as a cable, a rope, a wire or a chain, for example. A winch may include a guiding member which is used to guide the spoolable medium during spooling in or spooling out of the spoolable medium. The purpose of the guiding member is to keep the angle between the spoolable medium extending out of the winch drum and the winch drum's axis of rotation within predetermined limits, such as around 90 degrees depending on the construction of the winch, during spooling of the spoolable medium. In order to do this, the guiding member moves between two end positions along an axis which can be arranged substantially parallel to the winch drum's axis of rotation. An example of a winch having a guiding member is disclosed in EP 1786716.

The operation of the guiding member may be manually controlled or automatic. In an automatic operation the winch guiding member can, for example, move automatically between the two end positions such that the angle between the spoolable medium extending out of the winch drum and the winch drum's axis of rotation is kept within suitable limits during spooling of the spoolable medium. For example, when the spoolable medium is being spooled in on the winch drum or out from the winch drum, the guiding member moves towards one of the two ends until a layer of the spoolable medium on the winch drum is spooled in or out and then changes its moving direction and starts to move towards another one of the two ends in order to spool in or out the next layer of the spoolable medium.

If the winch guiding member is driven with an electric motor via a screw engaging the guiding member, for example, the change of the moving direction of the guiding member may be accomplished by changing the direction of rotation of the motor or by reversing a gearbox or a similar device possibly mounted between the motor and the screw, for example. The change of the moving direction of the guiding member can be performed when the guiding member reaches the proximity of one of the two end positions. Such control of the moving direction of the guiding member involves a proximity of one of the two end positions being detected somehow. One possible solution is to use proximity switches or sensors at both end positions to detect that the guiding member has reached the proximity of one of the two end positions.

An issue related to the use of proximity switches or sensors is that in marine applications or similar environments, for example, harsh ambient conditions may pose an issue for reliable operation of the proximity switches or sensors.

SUMMARY

A method is disclosed for operating a winch having a winch drum for spooling a spoolable medium, wherein the winch drum is rotatable about a first axis, and a guiding member for guiding the spoolable medium, wherein the guiding member is movable along a second axis between two end positions, the method comprising: driving the guiding member towards one of the two end positions by a first electric motor during spooling in or spooling out of the spoolable medium; monitoring a torque of the first electric motor or a quantity indicative thereof; and changing a driving direction of the guiding member in response to the torque of the first electric motor, or the quantity indicative thereof, exceeding a predetermined threshold.

A winch is disclosed comprising: a winch drum for spooling a spoolable medium, wherein the winch drum is rotatable about a first axis; a guiding member for guiding the spoolable medium, wherein the guiding member is movable along a second axis between two end positions; and an electric drive having a first electric motor for driving the guiding member towards one of the two end positions during spooling in or spooling out of the spoolable medium, wherein the electric drive is configured to monitor a torque of the first electric motor, or a quantity indicative thereof, and change the driving direction of the guiding member in response to the torque of the first electric motor, or the quantity indicative thereof, exceeding a predetermined threshold.

A winch is disclosed comprising: a winch drum for spooling a spoolable medium, wherein the winch drum is rotatable about a first axis; a guiding member for guiding the spoolable medium, wherein the guiding member is movable along a second axis between two end positions; an electric motor; and a control arrangement including a processor and a memory storing instructions that, when executed by the processor, will cause the control arrangement to: drive the guiding member towards one of the two end positions by the electric motor during spooling in or spooling out of the spoolable medium; monitor a torque of the electric motor or a quantity indicative thereof; and change a driving direction of the guiding member in response to the torque of the electric motor, or the quantity indicative thereof, exceeding a predetermined threshold.

BRIEF DESCRIPTION OF THE FIGURES

In the following, features and advantages disclosed herein will be described in more detail in connection with preferred exemplary embodiments with reference to the accompanying drawing, in which FIG. 1 illustrates a diagram of a winch according to an exemplary embodiment.

DETAILED DESCRIPTION

Methods and apparatus for implementing the methods are disclosed so as to solve or at least alleviate the issues already mentioned.

Exemplary embodiments provide for monitoring a torque of an electric motor driving a guiding member, or a quantity indicative of the torque, and determining that the guiding member has reached the proximity of one of two end positions when the torque of the electric motor, or the quantity indicative thereof, exceeds a predetermined threshold.

An advantage of exemplary embodiments is that they can enable the detection of the proximity of one of the two end positions without the use of any additional external components such as proximity switches or sensors. This can improve the reliability of the operation of the winch.

FIG. 1 illustrates a simplified diagram of a winch according to an exemplary embodiment. The FIGURE only shows components necessary for understanding the exemplary embodiment. The exemplary winch includes a winch drum 10 for spooling a spoolable medium 30, which winch drum is rotatable about a first axis 100. The spoolable medium 30 may be a cable, a rope, a wire or a chain, for example. The exemplary winch can include a guiding member 20 for guiding the spoolable medium 30, which guiding member is movable along a second axis 200 between two end positions 41, 42. The second axis 200 is for example substantially parallel to the first axis 100.

The guiding member 20 can include a fork-like or loop-like portion 21 or other suitable structure for engaging the spoolable medium 30. The guiding member 20 is used to guide the spoolable medium 30 during spooling in or spooling out of the spoolable medium 30. The purpose of the guiding member is to for example keep an angle between a portion 31 of the spoolable medium extending out of the winch drum 10 and the winch drum's axis of rotation 100 within predetermined limits during spooling of the spoolable medium 30.

The predetermined limits may vary and depend on the properties of the winch and the spoolable media in question, for example. Such predetermined limits may define a range around 90 degrees, for example. Thus, the predetermined limits could be 90°−x and 90°+x, where x defines a suitable angle variation from 90 degrees, for example. In this case parameter x depends on the construction and properties of the winch. In order to keep the angle within the predetermined limits, the guiding member 20 is for example adapted to move between the two end positions 41, 42 at a suitable speed during spooling of the spoolable medium 30. The moving speed of the guiding member 20 depends for example on the speed at which the spoolable medium 30 is being spooled in or out.

It is also possible to monitor the angle of the spoolable medium extending out of the winch drum 10 with respect to the winch drum's axis of rotation 100 using a suitable measuring system, such as a laser measurement device or encoders on both the winch drum and the guiding member, and then control the moving speed of the guiding member 20 according to the measurement information.

The guiding member 20 in the example of FIG. 1 is driven by means of an electric motor 50. The electric motor 50 may rotate a threaded screw 40 extending along and rotatable about the axis 200 between the two end positions 41, 42. When the guiding member 20 includes a suitable counter thread, it can engage the screw 40 and a rotation of the screw around the axis 200 consequently causes the guiding member to move towards one of the two end positions 41, 42 depending on the direction of the rotation of the screw 40.

It should be noted that the electric motor 50 could drive the guiding member 20 using other kind of transmission instead of the screw 40. A spooling guidance device including the guiding member 20 and the screw 40, for example, may include further elements or parts, such as support structures, not shown in the FIGURE.

The electric motor 50 driving the guiding member 20 can be of any type, such as an asynchronous AC motor, such as an induction motor, a synchronous AC motor or a DC motor. Moreover, exemplary embodiments as disclosed herein are not limited to systems employing any specific fundamental frequency or any specific voltage level.

In the example of FIG. 1, the electric motor 50 is an induction motor fed by an inverter 51 from a DC power supply 90. An inverter is a device used, for instance, for controlling a motor. The control of the electric motor 50 may be implemented reliably by means of the inverter 51 in such a manner that the motor accurately implements a desired speed or torque instruction, for example.

The exemplary embodiment can include a separate control unit 70 which may be used to control the electric motor 50 and to operate the guiding member 20. The control unit 70 may also be a part of the inverter 51 or some other unit, for example. The control unit 70 can be accessed through an I/O (Input-Output) device 80 such as a keyboard and display unit or another terminal unit which may be connected to the control unit 70 in a wired or wireless manner. Thus, an operator of the system can operate the guiding member through the I/O device 80.

The control unit 70 may also include suitable I/O means instead of or in addition to a separate I/O device 80. The electric motor 50, the inverter 51 and the control unit 70 may form or be part of an electric drive.

In the example of FIG. 1 the winch drum 10 is rotated by means of a second electric motor 60. The second electric motor 60 driving the winch drum can be of any type, such as an asynchronous AC motor, such as an induction motor, a synchronous AC motor or a DC motor. In the example of FIG. 1, the second electric motor 60 is an induction motor fed by an inverter 61 from a DC power supply 90. The second electric motor 60 may be controlled by the same control unit 70 as the first electric motor 50 or by another control unit.

The movement of the guiding member 20 towards one of the two end positions 41, 42 may be controlled such that the speed of the guiding member during spooling of the spoolable medium 30 is dependent on the speed at which the spoolable medium is being spooled in order to spool in/spool out the spoolable medium 30 layer upon layer on/from the winch drum 10. The spooling speed of the spoolable medium 30 is in turn dependent on the speed at which the winch drum 10 rotates. If a common control arrangement 70 is used for both motors 50, 60, then a suitable speed of the guiding member 20 may be controlled by the common control arrangement 70 which also knows the rotation speed of the winch drum 10.

If separate control arrangements are used for the motors 50, 60, then such control arrangements are for example synchronized in order to control the speed of movement of the guiding member 20. In this case one of the control arrangements, such as the control arrangement of the first electric motor 50, may act as a master and the other control arrangement, such as the control arrangement of the second electric motor 50, may act as a follower.

The movement of the guiding member 20 towards one of the two end positions 41, 42 could also be controlled in another manner, for example by observing the angle between the portion 31 of the spoolable medium extending out of the winch drum 10 and the winch drum's axis of rotation 100 and by moving the guiding member 20 towards one of the two end positions 41, 42 such that the angle is kept within predetermined limits.

According to an exemplary embodiment, when the guiding member 20 is being driven towards one of the two end positions 41, 42 and is determined to have reached a proximity of one of the two end positions, the driving direction of the guiding member is changed. In other words, if the guiding member 20 is driven towards the first end position 41 and the guiding member 20 reaches the proximity of the first end position 41, then the movement of the guiding member is changed and the guiding member 20 is started to be driven towards the second end position 42. In a corresponding manner, when the guiding member 20 is driven towards the second end position 42 and the guiding member 20 reaches the proximity of the second end position 42, then the movement of the guiding member is changed and the guiding member 20 is started to be driven towards the first end position 41.

According to an exemplary embodiment, a torque of the electric motor 50 driving the guiding member 20 or a quantity indicative of the torque is monitored and, when the torque of the electric motor 50, or the quantity indicative thereof, exceeds a predetermined threshold, it is determined that the guiding member has reached the proximity of one of the two end positions. In other words, the change of the driving direction of the guiding member 20 may be performed in response to the torque of the electric motor 50 or a quantity indicative thereof exceeding a predetermined threshold.

According to an exemplary embodiment, the quantity indicative of the torque of the electric motor 50 driving the guiding member 20 is a current of the electric motor 50. Also other possible quantities indicative of the torque of the electric motor 50 could be utilized. The monitoring of the torque of the electric motor 50 or the quantity indicative thereof, such as the current of the electric motor 50, may be performed by the control unit 70 which may receive the information readily from the inverter 51, for example. The value of the predetermined threshold of the torque of the electric motor 50, or the quantity indicative thereof, depends on the properties of the system in question.

When the guiding member 20 reaches one of the end positions 41, 42 and is mechanically stopped, the rotation of the screw 40 and, consequently, the electric motor 50 is mechanically stopped as well. As a result, the torque of the electric motor 50 starts to increase from the value it has when the guiding member 20 is moving towards one of the two end positions 41, 42. Thus, a suitable value of the predetermined threshold of the torque of the electric motor 50, or the quantity indicative thereof, may be a value above the value of the torque, or the quantity indicative thereof, during moving of the guiding member 20 towards one of the two end positions 41, 42.

According to an exemplary embodiment, the changing of the driving direction of the guiding member 20 can include stopping the driving of the guiding member for a predetermined period of time. According to an exemplary embodiment, the predetermined period of time may correspond approximately to a time during which the winch drum 10 rotates one revolution. That way, when the layer of the spoolable medium 30 changes due to the change of the driving direction of the guiding member 20, one full turn of the spoolable medium 30 is spooled on the new layer, if spooling in, or spooled from the new layer, if spooling out, before the guiding member 20 starts to move to the other direction.

An apparatus implementing the control functions according to any of the embodiments described herein, or any combination thereof, may be implemented as one unit or as two or more separate units that are configured to implement the functionality of the various embodiments. Here the term 'unit' refers generally to a physical or logical entity, such as a physical device or a part thereof or a software routine. One or more of these units, such as the control unit 70, may reside in an electric drive or a component thereof such as the inverter 51, for example.

An apparatus, such as the control unit 70, according to any of the embodiments disclosed herein may be implemented at least partly by means of one or more computers or corresponding digital signal processing (DSP) equipment provided with suitable software, for example. Such a computer or digital signal processing equipment can, for example, include at least a working memory (RAM) providing storage area for arithmetical operations and a central processing unit (CPU), such as a general-purpose digital signal processor. The CPU may include a set of registers, an arithmetic logic unit, and a CPU control unit. The CPU control unit is controlled by a sequence of program instructions transferred to the CPU from the RAM. The CPU control unit may contain a number of microinstructions for basic operations. The implementation of microinstructions may vary depending on the CPU design. The program instructions may be coded by a programming language, which may be a high-level programming language, such as C, Java, etc., or a low-level programming language, such as a machine language, or an assembler.

The computer may also have an operating system which may provide system services to a computer program written with the program instructions. The computer or other apparatus implementing the invention, or a part thereof, may further include suitable input means for receiving information such as measurement and/or control data, and output means for outputting information such as control data. It is also possible to use a specific integrated circuit or circuits, or discrete electric components and devices for implementing the functionality according to any of the disclosed exemplary embodiments.

Any of the exemplary embodiments, or any combination thereof, can be implemented in existing system elements, such as electric drives or components thereof, such as inverters or frequency converters, or similar devices, or by using separate dedicated elements or devices in a centralized or distributed manner. Present devices for electric drives, such as inverters and frequency converters, can include processors and memory that can be utilized in the functions according to exemplary embodiments disclosed herein.

Thus, all modifications and configurations required for implementing an exemplary embodiment of the invention, such as in existing devices, may be performed as software routines, which may be implemented as added or updated software routines. If the functionality disclosed herein is implemented by software, such software can be provided as a computer program product having computer program code which, when run on a computer, causes the computer or corresponding arrangement to perform the functionality according to the exemplary embodiments as described herein. Such a computer program code may be stored or generally embodied on a computer readable medium, such as suitable memory, such as a flash memory or a disc memory, from which it is loadable to the unit or units executing the program code. In addition, such a computer program code implementing an exemplary embodiment may be loaded to the unit or units executing the computer program code via a suitable data network, for example, and it may replace or update a possibly existing program code.

It will be apparent to those skilled in the art that as technology advances, the basic ideas disclosed herein can be implemented in a variety of ways. Consequently, the invention and its embodiments are not limited to examples discussed herein, but can vary within the scope of the claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A method for operating a winch having a winch drum for spooling a spoolable medium, wherein the winch drum is rotatable about a first axis, and a guiding member for guiding the spoolable medium, wherein the guiding member is movable along a second axis between two end positions, the method comprising:

driving the guiding member towards one of the two end positions by a first electric motor during spooling in or spooling out of the spoolable medium;

monitoring a torque of the first electric motor or a quantity indicative of the torque of the first motor; and changing a driving direction of the guiding member in response to the torque of the first electric motor, or the quantity indicative of the torque of the first motor, exceeding a predetermined threshold.

2. The method of claim 1, wherein the second axis is substantially parallel to the first axis.

3. The method of claim 1, wherein the winch drum is rotated about the first axis by a second electric motor during spooling in or spooling out of the spoolable medium.

4. The method of claim 1, wherein the quantity indicative of the torque of the first electric motor is a current of the first electric motor.

5. The method of claim 1, wherein the guiding member engages a screw extending along the second axis between the two end positions, wherein driving the guiding member towards one of the two end positions is performed by rotating the screw by the first electric motor.

6. The method of claim 1, wherein the changing of the driving direction of the guiding member comprises:

stopping the driving of the guiding member for a predetermined period of time.

7. The method of claim 6, wherein the predetermined period of time corresponds to a time during which the winch drum rotates one revolution.

8. A computer program product comprising computer program code embodied on a non-transitory computer readable medium, wherein execution of the program code in a computer causes the computer to carry out the steps of the method according to claim 1.

9. A winch comprising:

a winch drum for spooling a spoolable medium, wherein the winch drum is rotatable about a first axis;

a guiding member for guiding the spoolable medium, wherein the guiding member is movable along a second axis between two end positions; and an electric drive having a first electric motor for driving the guiding member towards one of the two end positions during spooling in or spooling out of the spoolable medium, wherein the electric drive is configured to monitor a torque of the first electric motor, or a quantity indicative of the torque of the first motor, and change a driving direction of the guiding member in response to the torque of the first electric motor, or the quantity indicative of the torque of the first motor, exceeding a predetermined threshold.

10. The winch of claim 9, wherein the second axis is substantially parallel to the first axis.

11. The winch of claim 9, comprising:

a second electric motor configured to rotate the winch drum about the first axis during spooling in or spooling out of the spoolable medium.

12. The winch of claim 9, wherein the quantity indicative of the torque of the first electric motor is a current of the first electric motor.

13. The winch of claim 9, comprising:

a screw extending along the second axis between the two end positions and engaging the guiding member, wherein the first electric motor is configured to drive the guiding member towards one of the two end positions by rotating the screw.

14. The winch of claim 9, wherein the spoolable medium is a cable, a rope, a wire or a chain.

15. The winch of claim 9, wherein the winch is an anchor winch, a mooring winch, a ramp winch or a towing winch.

16. A winch comprising:

a winch drum for spooling a spoolable medium, wherein the winch drum is rotatable about a first axis;

a guiding member for guiding the spoolable medium, wherein the guiding member is movable along a second axis between two end positions;

an electric motor; and a control arrangement including a processor and a memory storing instructions that, when executed by the processor, will cause the control arrangement to:

drive the guiding member towards one of the two end positions by the electric motor during spooling in or spooling out of the spoolable medium;

monitor a torque of the electric motor or a quantity indicative thereof; and change a driving direction of the guiding member in response to the torque of the electric motor, or the quantity indicative thereof, exceeding a predetermined threshold.

17. The method of claim 2, wherein the winch drum is rotated about the first axis by a second electric motor during spooling in or spooling out of the spoolable medium.

18. The method of claim 17, wherein the guiding member engages a screw extending along the second axis between the two end positions, wherein driving the guiding member towards one of the two end positions is performed by rotating the screw by the first electric motor.

19. The method of claim 18, wherein the changing of the driving direction of the guiding member comprises:

stopping the driving of the guiding member for a predetermined period of time, wherein the predetermined period of time corresponds to a time during which the winch drum rotates one revolution.

20. The winch of claim 10, comprising:

a screw extending along the second axis between the two end positions and engaging the guiding member, wherein the first electric motor is configured to drive the guiding member towards one of the two end positions by rotating the screw.

* * * * *